United States Patent [19]

Plummer

[11] Patent Number: 4,623,445

[45] **Date of Patent: * Nov. 18, 1986**

[54] SODIUM TETRACHLOROALUMINATE CATALYZED PROCESS FOR THE MOLECULAR WEIGHT REDUCTION OF LIQUID HYDROCARBONS

[75] Inventor: Mark A. Plummer, Littleton, Colo.

[73] Assignee: Marathon Oil Company, Findlay, Ohio

[ * ] Notice: The portion of the term of this patent subsequent to Mar. 12, 2002 has been disclaimed.

[21] Appl. No.: 677,960

[22] Filed: Dec. 4, 1984

Related U.S. Application Data

[63] Continuation-in-part of Ser. No. 467,698, Feb. 18, 1983, Pat. No. 4,504,378.

[51] Int. Cl.[4] ..... C10G 11/08; C10G 19/67; C10G 29/12; C10G 47/08

[52] U.S. Cl. ..... 208/108; 208/117; 208/214; 208/230; 208/235; 208/254 H; 208/263

[58] Field of Search ..... 208/108, 115, 116, 117, 208/235, 248, 254 H, 254 R, 284, 297, 214, 230, 263

[56] References Cited

U.S. PATENT DOCUMENTS

| | | | |
|---|---|---|---|
| 4,504,378 | 3/1985 | Plummer | 208/108 |
| 4,505,810 | 3/1985 | Plummer | 208/108 |
| 4,555,327 | 11/1985 | Plummer | 208/108 |
| 4,557,803 | 12/1985 | Plummer | 208/108 |

*Primary Examiner*—Brian E. Hearn
*Assistant Examiner*—O. Chaudhuri
*Attorney, Agent, or Firm*—Jack L. Hummel; Rodney F. Brown

[57] ABSTRACT

A process for reducing the molecular weight of hydrocarbons using $NaAlCl_4$ is provided wherein the hydrogen to carbon ratio of the liquid product slate is approximately the same as the feed material. The process comprises contacting the feed material with a molten salt of $NaAlCl_4$ having substantially no excess aluminum chloride or sodium chloride, preferably at a temperature of at least 660° F., and at a pressure above atmospheric, preferably from about 50 psia to about 2000 psia, depending upon the product slate desired. According to the present invention, heavy hydrocarbons are converted to a liquid product slate wherein the product slate has an average molecular weight substantially lower than the average molecular weight of the hydrocarbon feedstock.

30 Claims, No Drawings

SODIUM TETRACHLOROALUMINATE CATALYZED PROCESS FOR THE MOLECULAR WEIGHT REDUCTION OF LIQUID HYDROCARBONS

DESCRIPTION

This is a continuation in part of application Ser. No. 467,698, filed on Feb. 18, 1983, now U.S. Pat. No. 4,504,378.

FIELD OF INVENTION

This invention relates to processes for upgrading heavy liquid hydrocarbons by reducing their molecular weight and, in particular, to processes using sodium tetrachloroaluminate as the catalyst.

BRIEF DESCRIPTION OF THE PRIOR ART

Extensive work has been directed towards transforming heavy hydrocarbons such as liquefied coal, asphalts, petroleum residual oils and the like into lighter, more useful hydrocarbon products, such as synthetic crudes. Most processes relate to the cracking and subsequent hydrogenation of such feed materials in the presence of a variety of catalysts including molten salts. Most known processes involve consumption of expensive hydrogen and/or the rejection of carbon to a low value product. Exemplary of such processes are those described in U.S. Pat. Nos. 3,966,582; 2,768,935; 4,317,712; 4,333,815; 1,825,294 and 3,765,515. These teach the use of a wide variety of halide salts and mixtures thereof as the catalytic reaction matrix. U.S. Pat. Nos. 4,317,712 and 4,333,815 disclose mixing aromatic hydrocarbons with a coal or petroleum oil feed which is subsequently cracked using $ZnCl_2$ and $AlCl_3$ as Friedel-Crafts catalysts. U.S. Pat. Nos. 1,825,294 and 3,764,515 disclose the use of a gaseous mineral acid, such as HCl, as a promoter for $ZnCl_2$ and $AlCl_3$. These references do not, however, teach the use of sodium tetrachloroaluminate ($NaAlCl_4$) as a useful catalyst for reducing the molecular weight of liquid hydrocarbons. $NaAlCl_4$ has been used in the treatment of oil shale with subsequent benzene extraction to produce raw shale oil, i.e., R. C. Bugle et al, Nature, Vol. 274, No. 5671, pp. 578–580.

Moreover, while the concept of converting heavy hydrocarbons to a slate of lower molecular weight liquids having approximately the same hydrogen to carbon (H/C) ratio as the feed may have been contemplated, to date prior art efforts have not proven this technically feasible. A key advantage of maintaining the H/C ratio is the elimination of cost of hydrogen consumption or the need to produce the large quantities of hydrogen in situ.

$NaAlCl_4$ is a known catalyst for a number of reactions. For example, U.S. Pat. Nos. 2,125,235 and 2,146,666 disclose the use of $NaAlCl_4$ for polymerization of hydrocarbon gases, e.g., olefins. U.S. Pat. No. 2,342,073 discloses the use of $NaAlCl_4$ for the isomerization of paraffins. U.S. Pat. Nos. 2,388,007 and 3,324,192 teach the use of $NaAlCl_4$ as a catalyst to alkylate aromatic hydrocarbons. U.S. Pat. No. 2,113,028 teachs a method of regenerating such double halide catalysts as $NaAlCl_4$. None of these references, however, suggests the use of $NaAlCl_4$ as a catalyst for molecular weight reduction of heavy liquid hydrocarbons.

Heretofore, there has been little success or effort in development of processes wherein high molecular weight hydrocarbon liquids are transformed into a primarily liquid product slate having approximately the same hydrogen to carbon ratio as the initial feeds. Similarly, heretofore there has been no recognition that $NaAlCl_4$ may most advantageously be utilized to that end in a process at elevated temperatures and pressures.

Accordingly, it is an object of this invention to provide such a process.

BRIEF SUMMARY OF THE INVENTION

A process for reducing the molecular weight of hydrocarbons using $NaAlCl_4$ is provided wherein the hydrogen to carbon ratio of the product slate is approximately the same as the feed material, comprising contacting the feed material with a molten salt of $NaAlCl_4$, having substantially no excess aluminum chloride or sodium chloride, at a pressure of from about 50 psia to about 2000 psia, and preferably at a temperature of at least 660° F., depending upon the product slate desired.

DETAILED DESCRIPTION OF THE INVENTION

The feed materials useful in the practice of the present invention are heavy, or high molecular weight hydrocarbons, typically viscous liquids, such as liquefied or solvent refined coal, asphalt, including asphaltenes and preasphaltenes, tar, shale oil, petroleum residual oils, oils extracted from tar sands, and heavy petroleum crude oils boiling below about 1500° F. In general, while most advantageously applied to petroleum residuals and shale oils, virtually any hydrocarbon can be utilized.

Low molecular weight hydrocarbons can be added to the feed material. These additives can include hydrogen donor materials, such as partially saturated aromatics (e.g., tetralin), or free radical acceptors such as aromatics and olefins. The hydrocarbon additives can also be nonreactive materials (e.g., paraffins) used only to reduce the concentration or viscosity of the feed material. The amount of additive, which will generally be recycled, will usually be less than four times the feed material on a weight basis.

The $NaAlCl_4$ molten salt catalyst useful in the practice of the present invention is manufactured by mixing aluminum chloride ($AlCl_3$) and sodium chloride (NaCl). In general, no excess NaCl is to be employed in the manufacture of the $NaAlCl_4$ catalyst. In a preferred embodiment, the molar ratio of $AlCl_3$ to NaCl in the mixture from which the catalyst is manufactured is slightly greater than one to one, i.e., there is about a 1 to 10 mole percent excess of $AlCl_3$, in order to assure complete conversion of NaCl to $NaAlCl_4$. In these instances, substantially all of the excess $AlCl_3$ is vaporized during the manufacture of the $NaAlCl_4$ leaving the final $NaAlCl_4$ product, having substantially no excess NaCl or $AlCl_3$. In some cases, the molten $NaAlCl_4$ can be raised to a higher activity level by treating it with dry hydrogen chloride gas prior to contacting the catalyst with the feed material. This treatment usually occurs at the catalyst manufacturing temperature of from about 300° to about 400° F. and employs hydrogen chloride (HCl) at pressures of from about atmospheric to about 1000 psia.

In operation, it is believed that the molten salt of the present invention is not acting merely as a molecular weight reduction catalyst. These molten salts as indicated herein have been used in paraffin isomerization, alkylation of aromatics and olefin saturation and polymerization. Accordingly, it is believed that the initial function of the molten $NaAlCl_4$ of the present invention is in the formation of free radicals from a portion of the feed. The free radicals thus produced react via a series of mechanisms to form a slate of liquid products primarily comprising branched paraffins, aromatics and naphthenes.

The process is carried out under pressure. While any pressure above atmospheric is acceptable, the process is most advantageously operated at pressures from 50 psia up to about 2000 psia, preferably from about 100 psia to about 1000 psia. These pressures represent a significant decrease from those required in most commercial weight reduction processes via hydrogenation. The reaction temperature at which the feed and molten $NaAlCl_4$ are contacted is typically from about 660° F. to about 1000° F., preferably from about 750° F. to about 850° F. and most preferably about 800° F.

Selection of the molecular weight reduction conditions is dependent to some extent upon the nature of the feed material, but is primarily dependent on the desired average molecular weight of the products and on the desired level of contaminant (i.e., sulfur, nitrogen, and oxygen) removal. The terms "products" and "product slate" as used herein are equivalent. They refer to the mixture of hydrocarbon compounds obtained from the catalytic reaction of the feedstock. The term "product" refers to an individual compound within the "products" or "product slate". For purposes of this invention, optimization is considered to be a maximum yield of liquid products and minimum yields of gas and catalyst residue. The high hydrogen to carbon ratio of gases usually results from leaving low hydrogen to carbon residues on the catalyst, and thus it is desirable to maximize the production of liquid products of essentially the same hydrogen to carbon ratio as the feed.

The distillation range of the liquid products should be less than that of the feed materials, e.g., less than about 1000° F. for a petroleum residual oil feed. In some cases, it is preferable that the liquid products should all distill in the range between isobutane (about 11° F.) and the end point of typical gasolines (about 425° F.). The average molecular weight of the liquid products is less than the average molecular weight of the hydrocarbon feedstock although an individual product may have a molecular weight within the range of the hydrocarbon feedstock.

A purge gas, which is typically recycled, is required to remove the liquid products from the molten $NaAlCl_4$. Below an operating pressure of about 622 psia, the purge can be either an inert gas such as nitrogen, carbon dioxide, helium, and the other Inert Gases of The Periodic Table, methane, etc. or a reactive gas such as hydrogen, carbon monoxide or low molecular weight aromatics, olefins and hydrogen donor materials which react with or donate hydrogen to the products produced. Mixtures of inert and reactive gases can also be used.

The yield and composition of the liquids products and the level of contaminant removal are essentially not affected by the purge gas composition for a given operating temperature and pressure below about 622 psia. This is an unexpected result in that most molecular weight reduction processes require the consumption of an external source of hydrogen. At pressures above about 622 psia, the use of an external hydrogen source will improve contaminant removal but will not affect the molecular weight range of the liquid products. The purge gas can also contain a quantity of hydrogen chloride gas to counteract the introduction of oxygen as a feed contaminant or in the form of dissolved water. Oxygen will convert the catalyst from the chloride to the oxide form and deactivate the catalyst.

During the molecular weight reduction of hydrocarbons according to the present invention, a large amount of low molecular weight free radicals are formed. These free radicals are saturated with hydrogen and yield compounds having high H/C ratios. This requires the use of an external source of hydrogen to saturate the free radicals or that carbon be rejected to the catalyst surface yielding the needed hydrogen in situ. The carbon must then be periodically removed to reactivate the catalyst. The addition of a free radical acceptor, i.e., electrophiles such as benzene and naphthalene, to either the purge gas or the feedstock results in the acceptor reacting with the free radicals, and thereby allowing the hydrogen in the feed to be efficiently used for molecular weight reduction and contaminant removal. When the acceptors are added to the feed alone or in conjunction with other additives, they can also act to dilute the feed and result in a more uniform distribution of the feed on the catalyst. Gaseous free radical acceptors can alternatively be added to either a reactive or non-reactive purge gas or used alone as the purge gas itself.

Certain hydrocarbon feedstocks contain components exhibiting very low H/C ratios. These components quickly form carbon residues on the $NaAlCl_4$ catalyst which cannot be easily removed by hydrogen generated in situ from the feedstock or supplied externally. In these cases, a hydrogen donor material (e.g., tetralin) will donate hydrogen free radicals which increase the H/C ratio of the residue and thereby facilitate its removal from the $NaAlCl_4$ as liquid products. These hydrogen donor additives are preferably added to the feedstock, but they can alternatively be added to a reactive or non-reactive purge gas or used alone as the purge gas.

These and other aspects of the invention may be best understood by reference to the following examples which are offered by way of illustration and not by way of limitation.

The following examples and optimization studies were performed using a grade AC-20 asphalt, unless indicated otherwise, and an $NaAlCl_4$ molten salt. The experiments were performed at the conditions indicated in a continuous reactor. Unless indicated otherwise, the $NaAlCl_4$ molten salt contained substantially no excess NaCl or $AlCl_3$ and was produced by mixing $AlCl_3$ and NaCl at 300°–400° F. under helium at atmospheric pressure.

EXAMPLE I

Reaction Temperature vs. Product Yield

A series of tests were performed at 113–121 psia and at a variety of temperatures to determine the effect of temperature on yields. The results obtained are tabulated in Table I.

TABLE I

| Temperature °F. | Purge Gas | Yields As Wt % of Feed | | |
|---|---|---|---|---|
| | | Liquid | Gas | Catalyst Residue |
| 600 | Hydrogen | 19.0 | none | 81.0 |
| 660 | Hydrogen | 36.5 | none | 63.5 |
| 750 | Hydrogen | 63.5 | none | 36.5 |
| 800 | Hydrogen | 65.0 | 14.0 | 21.0 |
| 820 | Hydrogen | 67.5 | 13.5 | 19.0 |

TABLE I-continued

| Temperature °F. | Purge Gas | Yields As Wt % of Feed Liquid | Gas | Catalyst Residue |
|---|---|---|---|---|
| 850 | Hydrogen | 64.0 | 10.0 | 26.0 |
| 900 | Helium | 44.0 | 6.0 | 50.0 |

As the data in Table I demonstrate, the amount of residue left on the catalyst decreased from 81 to 19 weight percent as the temperature was increased from 600° F. to about 820° F. It is believed that the residue which remained via these temperatures was in all likelihood unreacted feed of a lower hydrogen to carbon ratio. Above about 820° F. the residue on the catalyst again increased, probably due to a coking environment created by the higher temperatures. Hence, there is an optimum operating temperature between 600°-660° F. and the temperatures above about 820° F. which result in thermal coking.

EXAMPLE II

Reaction Pressure vs. Yields, Liquid Product Quality, Hydrogen Production, and Contaminant Removal A series of tests were performed at 804±4° F. under varying pressures. A test at a pressure of 12 psia was performed for comparison. The results are tabulated in Table II and III for yields and product quality, respectively.

TABLE II

| Pressure psia | Purge Gas | Yields As Wt % of Feed Liquid | Gas | Catalyst Residue |
|---|---|---|---|---|
| 12 | Hydrogen | 68.8 | 16.6 | 14.6 |
| 121 | Hydrogen | 65.3 | 14.1 | 20.6 |
| 269 | Hydrogen | 63.5 | 8.5 | 28.0 |
| 419 | Hydrogen | 66.3 | 3.8 | 29.9 |
| 616 | Hydrogen | 64.5 | none | 35.5 |
| 622 | Helium | 63.5 | 0.1 | 36.1 |
| 826 | Hydrogen | 66.0 | 0.7 | 33.3 |

The data in Table II indicate that a portion of the asphalt feed is converted into liquid products with yields (64-69%) essentially independent of pressure and purge gas type, i.e., reactive hydrogen or inert helium. The balance is converted either into gaseous products, mostly methane through propane, or a catalyst residue. The gas yield can optimally be reduced by increasing the operating pressure. This is an unexpected result since in most processes higher hydrogen pressures result in higher gas yields.

TABLE III

| Pressure psia | Purge Gas | Liquid Products Distillation Range - °F. 11 | 11-425 | 425-1000 | 1000+ |
|---|---|---|---|---|---|
| 12 | Hydrogen | none | 18.5 | 71.5 | 10.0 |
| 121 | Hydrogen | 12.0 | 55.5 | 32.5 | none |
| 269 | Hydrogen | 15.0 | 69.5 | 15.5 | none |
| 419 | Hydrogen | 15.0 | 83.5 | 1.5 | none |
| 616 | Hydrogen | 17.5 | 81.0 | 1.5 | none |
| 622 | Helium | 15.0 | 83.5 | 1.5 | none |
| 826 | Hydrogen | 17.5 | 81.0 | 1.5 | none |

From Table III, it can be seen that as pressure was increased, the boiling point range (i.e., molecular weight) of the liquid products decreased. At atmospheric pressure (about 12 psia), the liquid products were essentially a synthetic crude oil, i.e., 81.5% of the products had a boiling point above 425° F. At 419 psia, 98.5% of the liquid products boiled below the gasoline end point of 425° F. For operating pressures between 419 and 826 psia, the boiling point range of the liquid products did not vary significantly. Also the use of inert helium as the purge gas yielded the same molecular weight reduction as did the use of reactive hydrogen.

The component types existing in the 86±500° F. portion ($C_6$-$C_{13}$) of the liquid products were evaluated and the results provided in Table IV. The results show that mostly branched paraffins, naphthenes and aromatics were produced. The ratio of branched to normal paraffins for the $C_6$-$C_{13}$ compounds ranged from 7.1 to 10.1. As reaction pressure was increased, the concentration of olefins and naphthenes decreased. The olefins were probably converted to isoparaffins and the naphthenes to aromatics.

TABLE IV

| Pressure-psia Components | 269 | 419 | 615 | 822 |
|---|---|---|---|---|
| Paraffins | | | | |
| Normal | 3.7 | 3.9 | 3.9 | 3.5 |
| Branched | 34.3 | 39.5 | 28.0 | 32.9 |
| Olefins | 0.7 | 1.0 | 0.5 | 0.0 |
| Naphthenes | 14.9 | 13.2 | 10.9 | 8.4 |
| Aromatics | 46.4 | 42.4 | 56.7 | 55.2 |

In the same series of tests, the amount of hydrogen produced or consumed was measured along with the removal level of contaminants. The results are tabulated in Table V.

TABLE V

| Pressure psia | Purge Gas | Hydrogen - SCF/Bbl AC-20 Production | Consumption | Wt % Sulfur In* Liquid | Residue |
|---|---|---|---|---|---|
| 12 | Hydrogen | 59 | none | 49.6 | — |
| 121 | Hydrogen | 297 | none | 24.4 | 21.7 |
| 117 | Helium | 300 | none | 19.6 | — |
| 269 | Hydrogen | 250 | none | — | 29.4 |
| 419 | Hydrogen | 146 | none | 3.2 | 33.8 |
| 616 | Hydrogen | 45 | none | — | 15.6 |
| 622 | Helium | 5 | none | — | 10.7 |
| 826 | Hydrogen | none | 146 | — | 7.7 |

*Based on the amount of sulfur in AC-20 feed (3.89 wt %). Balance of sulfur is produced as hydrogen sulfide.

At reaction pressures below 622 psia, excess hydrogen was produced using either hydrogen or inert helium as the purge gas. This is not necessarily undesirable since the hydrogen produced could be used to remove the residue left on the catalyst. Slightly above 622 psia reaction pressure, hydrogen consumption starts to occur. At 826 psia, hydrogen consumption reached above 146 SCF/bbl. This amount of consumption is essentially equal to that (152 SCF/bbl of AC-20 feed) required to remove all the sulfur in the feed. The data in Table V indicate that 92.3% of the sulfur in the AC-20 feed was recovered as hydrogen sulfide at the operating pressure of 826 psia. Essentially all the sulfur was removed from the liquid products at pressures slightly above 622 psia. The levels of desulfurization achieved with the molten $NaAlCl_4$ catalyst at pressures of 622-826 psia are better than those typically achieved with other commercial desulfurization processes.

Since the composition of the liquid products did not change significantly between operating pressures of 419 and 826 psia and the sulfur removal level increased, we conclude that an external hydrogen source will be needed only for complete contaminant removal. Thus, the use of molten $NaAlCl_4$ will minimize hydrogen consumption over commercial processes for molecular weight reduction of residual oils, etc.

EXAMPLE III

Nitrogen and Oxygen Removal

An additional experiment was performed in which shale oil, containing 1.22 and 2.11 weight percent, respectively, of oxygen and nitrogen contaminants, was contacted with molten $NaAlCl_4$ at 798° F. and 812 psia with a hydrogen purge. The liquid products contained 0.09 and 0.07 weight percent of oxygen and nitrogen, respectively. This amount of nitrogen in the liquid products represents only 2.6 weight percent of that in the original shale oil. Most of the oxygen in the liquid products is believed to be dissolved water which means that the overall oxygen removal was in excess of 95 percent.

As can be seen from Example III, oxygen- and/or nitrogen-containing feedstocks when treated according to the present invention, can result in liquid products substantially free of oxygen and/or nitrogen which for purposes of the present invention means less than about 0.5 percent by weight.

EXAMPLE IV

Catalyst Modification vs. Liquid Products Yield

A series of tests were performed at 804±5° F., 814±4 psia, and with a hydrogen purge to modify the activity level of the molten $NaAlCl_4$ catalyst. The results are tabulated in Table VI.

TABLE VI

| Catalyst Modification Over Standard 1/1 Molar Ratio of $AlCl_3$/NaCl | Yields as Wt % of Feed | | |
|---|---|---|---|
| | Liquid | Gas | Residue |
| No Modification | 68.7 ± 1.2 | none | 31.3 ± 1.2 |
| 2% Excess NaCl | 60.8 | none | 39.2 |
| 2% Excess $AlCl_3$ | 67.8 | none | 32.2 |
| HCl Treatment at 12 psia | 74.5 | none | 25.5 |
| HCl Treatment at 530 psia | 64.6 | 12.2 | 23.2 |

The results in Table VI show that the use of excess NaCl in the manufacture of the $NaAlCl_4$ catalyst is undesirable. That is, liquid products yield was lost with a corresponding increase in residue yield. In these studies, the use of excess $AlCl_3$ resulted in no benefit. However, it is believed that in some cases the use of excess $AlCl_3$ will be beneficial. The concentration of excess $AlCl_3$ will be limited by its volatility at operating pressure and temperature. The results also show that adding HCl gas during catalyst manufacture desirably results in reduced residue yields. At 12 psia of HCl pressure, the loss in residue is converted totally into liquid products yield. For an HCl pressure of 530 psia, the residue loss is partially converted into gas. This gas production could advantageously be converted into liquid products by operating at a higher pressure during the molecular weight reduction step.

EXAMPLE V

Effect of a Hydrogen Donor Feed Additive and a Free Radical Acceptor on Yields Several experiments were performed to evaluate the use of tetralin as a hydrogen donor additive to the AC-20 feed. These experiments were performed at 801±2° F., 812 psia, and with a hydrogen purge. The results are given in Table VII.

TABLE VII

| Wt % Tetralin In Feed | Yields-Wt % of Feed | | Composition of the $C_6$–$C_{13}$ Portion of the Liquid Products - Vol % | | |
|---|---|---|---|---|---|
| | Liquid | Residue | Paraffins | Naphthenes | Aromatics |
| none | 68.7 ± 1.2 | 31.3 ± 1.2 | 37.1 | 8.2 | 54.7 |
| 20.0 | 76.4 | 23.6 | 21.2 | 6.3 | 72.5 |

The results show that the use of tetralin desirably increases the liquid products yield and reduces the residue yield. Also, the $C_6$–$C_{13}$ portion of the liquid products contains more aromatic components. The production of more aromatics helps achieve the goal of obtaining liquid products whose hydrogen to carbon ratio equals that of the feed. The results also show that the tetralin was converted into naphthalene and alkyl naphthalenes. The production of naphthalene means that the tetralin was acting as a hydrogen donor. The production of alkyl naphthalenes shows that the naphthalene resulting from hydrogen donation acts as a free radical acceptor.

Additional results show that a purge gas circulation of 1200–1500 SCF of hydrogen or helium per barrel of AC-20 feed is required to remove the liquid from the molten catalyst. These optimum rates were determined at an operating pressure of about 120 psia. The lighter liquid products made at higher operating pressures required slightly less purge gas circulation. And likewise, the heavier liquid products made at pressures lower than 120 psia required slightly more purge gas circulation.

Most of the above-reported experiments were performed at a reactor residence time of about 60 minutes (lb catalyst per lb/minute of asphalt feed). Lower residence times were also evaluated and it was found that no loss in liquid yield occurred down to about 30 minutes. At a residence time of 15 minutes, liquid production rate was reduced by 15%, but this is thought to be due to an inability during experimentation to supply sufficient heat to control reaction temperature at the optimum level.

When using fresh catalyst, a certain period of time is required for some carbon buildup on the catalyst to optimize the liquid production rate. During this period, gas and residue yields are slightly higher. As the process continues, more residue is deposited and eventually the activity of the catalyst decreases to a point where liquid production stops. Hence, after a certain carbon buildup, the catalyst should advantageously be replaced or regenerated.

An additional advantage of the molten salt catalyst of the present invention is that metal contaminants in the feed are incorporated in the melt, and apparently do not reduce the activity of the catalyst. However, at some point, large concentration of metals will likely either dilute or reduce the activity of the catalyst. At such a time, the catalyst should again be replaced.

Although the foregoing invention has been described in some detail by way of illustration and example for purposes of clarity and understanding, it will be obvious that certain changes and modifications may be practiced within the scope of the invention, as limited only by the scope of the appended claims.

I claim:

1. A process for reducing the molecular weight of a high molecular weight hydrocarbon feedstock comprising contacting said feedstock with a molten tetrachloroaluminate catalyst consisting essentially of $NaAlCl_4$, having substantially no excess NaCl or $AlCl_3$, at a pressure above atmospheric and at elevated temperature to produce a liquid product slate wherein said product slate has an average molecular weight substantially lower than the average molecular weight of said feedstock.

2. A process according to claim 1 wherein said contacting is at a temperatuer of from about 660° F. to about 1000° F.

3. A process according to claim 2 wherein said temperature is from about 750° to about 850° F.

4. A process according to claim 3 wherein said temperature is about 800° F.

5. A process according to claim 1 wherein said pressure is from about 50 psia to about 2000 psia.

6. A process according to claim 5 wherein said pressure is from about 100 psia to about 1000 psia.

7. A process according to claim 1 further comprising separating said liquid product slate by purging with a purge gas.

8. A process according to claim 7 wherein at least a portion of said purge gas is reactive.

9. A process according to claim 7 wherein at least a portion of said purge gas is inert.

10. A process according to claim 7 wherein said purge gas is selected from the group consisting of helium, hydrogen, methane, carbon dioxide, carbon monoxide, aromatics, olefins, hydrogen donors, free radical acceptors and mixtures thereof.

11. A process according to claim 7 wherein said purge gas contains hydrogen chloride.

12. A process according to claim 7 wherein said purge gas is separated from said liquid product slate and is recycled.

13. A process according to claim 1 wherein the hydrogen to carbon ratio of said liquid product slate is substantially the same as the hydrogen to carbon ratio of said feedstock.

14. A process according to claim 1 wherein said feedstock is selected from the group consisting of liquefied coal, solvent refined coal, asphalt, asphaltenes, preasphaltenes, tar, shale oil, petroleum residual oils, oils extracted from tar sands, heavy petroleum crude oils boiling below about 1500° F. and mixtures thereof.

15. A process according to claim 1 wherein said feedstock further comprises an additive selected from the group consisting of free radical acceptors, hydrogen donors and non-reactive paraffins.

16. A process according to claim 15 wherein said additive is present in an amount up to four times said feedstock on a weight basis.

17. A process according to claim 1 wherein said molten $NaAlCl_4$ is pretreated with gaseous HCl before contacting said feedstock.

18. A process for producing a liquid hydrocarbon product slate from a heavy liquid hydrocarbon feedstock comprising contacting said feedstock with a molten tetrachloroaluminate consisting essentially of $NaAlCl_4$, having substantially no excess NaCl or $AlCl_3$, at a temperature above about 660° F. and at a pressure above about 50 psia and separating said liquid product slate from said molten tetrachloroaluminate by purging with a purge gas, wherein said product slate has an average molecular weight substantially lower than the average molecular weight of said feedstock.

19. A process according to claim 18 wherein the hydrogen to carbon ratio of said liquid product slate is substantially the same as the hydrogen to carbon ratio of said feedstock.

20. A process according to claim 18 wherein said feedstock has a boiling point above about 425° F. and substantially all the components of said product slate boil below about 425° F.

21. A process according to claim 18 wherein said feedstock is sulfur-containing and said sulfur is removed as hydrogen sulfide to produce a liquid product slate substantially free of sulfur.

22. A process according to claim 18 wherein said feedstock is nitrogen-containing and nitrogen is removed as ammonia to produce a liquid product slate substantially free of nitrogen.

23. A process according to claim 18 wherein said feedstock is oxygen-containing and oxygen is removed as water to produce a liquid product slate substantially free of oxygen.

24. A process according to claim 18 wherein said purge gas contains HCl.

25. A process according to claim 18 wherein said feedstock further comprises at least one additive selected from the group consisting of free radical acceptors and hydrogen donors.

26. A process according to claim 18 wherein said purge gas comprises a reactive gas.

27. A process according to claim 18 wherein said purge gas comprises an inert gas.

28. A process according to claim 18 wherein said catalyst is pretreated with HCl before contacting said feedstock.

29. A process according to claim 28 wherein said catalyst pretreatment is at a temperature of from about 300° F. to about 400° F. and at a pressure of from about atmospheric to about 1000 psia.

30. A process according to claim 18 wherein said purge gas further comprises a gas additive selected from the group consisting of free radical acceptors and hydrogen donors.

* * * * *

UNITED STATES PATENT AND TRADEMARK OFFICE

CERTIFICATE OF CORRECTION

PATENT NO. : 4,623,445

DATED : November 18, 1986

INVENTOR(S) : Mark A. Plummer

It is certified that error appears in the above–identified patent and that said Letters Patent are hereby corrected as shown below:

Col. 1, line 30: Delete "3,765,515" and insert --3,764,515--.

Col. 6, line 5: Delete "86±500° F" and insert --86-500° F--.

Col. 6, Table IV: Redraft as follows:

Table IV

| Pressure - psia | 269 | 419 | 615 | 822 |
|---|---|---|---|---|
| Components - Vol% | | | | |
| Paraffins | | | | |
| Normal | 3.7 | 3.9 | 3.9 | 3.5 |
| Branched | 34.3 | 39.5 | 28.0 | 32.9 |
| Olefins | 0.7 | 1.0 | 0.5 | 0.0 |
| Naphthenes | 14.9 | 13.2 | 10.9 | 8.4 |
| Aromatics | 46.4 | 42.4 | 56.7 | 55.2 |

Col. 9, line 11: Delete "temperatuer" and insert --temperature--.

Signed and Sealed this

Thirty-first Day of March, 1987

*Attest:*

*Attesting Officer*

DONALD J. QUIGG

*Commissioner of Patents and Trademarks*